US008945367B2

(12) United States Patent
Hart et al.

(10) Patent No.: US 8,945,367 B2
(45) Date of Patent: Feb. 3, 2015

(54) ELECTROLYTIC APPARATUS, SYSTEM AND METHOD FOR THE SAFE PRODUCTION OF NITROGEN TRIFLUORIDE

(75) Inventors: James Joseph Hart, Fogelsville, PA (US); Reinaldo Mario Machado, Allentown, PA (US); Howard Paul Withers, Jr., Breinigsville, PA (US); Sai-Hong A. Lo, Allentown, PA (US); Edward Jay Cialkowski, Allentown, PA (US); Krishnakumar Jambunathan, Breinigsville, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 873 days.

(21) Appl. No.: 13/008,649

(22) Filed: Jan. 18, 2011

(65) Prior Publication Data

US 2012/0181182 A1 Jul. 19, 2012

(51) Int. Cl.
*C25B 1/24* (2006.01)
*C25B 15/08* (2006.01)

(52) U.S. Cl.
CPC ..... *C25B 1/245* (2013.01); *C25B 15/08* (2013.01)
USPC ..... 205/359; 205/360

(58) Field of Classification Search
USPC ..... 205/359, 360; 204/228.1, 242
See application file for complete search history.

(56) References Cited

U.S. PATENT DOCUMENTS

| | | | | |
|---|---|---|---|---|
| 3,235,474 | A | 2/1966 | Tompkins, Jr. et al. | |
| 5,084,156 | A | 1/1992 | Iwanaga et al. | |
| 5,085,752 | A | 2/1992 | Iwanaga et al. | |
| 5,366,606 | A | 11/1994 | Tarancon | |
| 5,779,866 | A | 7/1998 | Tarancon | |
| 6,361,679 | B1 * | 3/2002 | Kikkawa et al. | 205/359 |
| 2004/0099537 | A1 | 5/2004 | Hiraiwa et al. | |
| 2007/0215460 | A1 | 9/2007 | Tojo et al. | |

FOREIGN PATENT DOCUMENTS

| | | | |
|---|---|---|---|
| CN | 2516568 | Y | 10/2002 |
| CN | 1450202 | A | 10/2003 |
| CN | 101798689 | A | 8/2010 |
| EP | 1283280 | A1 | 2/2003 |
| JP | 2896196 | B2 | 5/1999 |
| JP | 2000104186 | | 4/2000 |
| JP | 2005097667 | A2 | 4/2005 |
| KR | 20070057489 | A | 6/2007 |
| WO | 2005031039 | A2 | 4/2005 |
| WO | 2006104416 | A1 | 10/2006 |

OTHER PUBLICATIONS

Huber, A. P., et al.; "Multi-ton Production of Fluorine for Manufacture of Uranium Hexafluoride", Proceedings of the Second United Nations International Conference on the Peaceful Uses of Atomic Energy, Geneva Switzerland, Sep. 1-13, 1958, pp. 172-180.

* cited by examiner

*Primary Examiner* — Arun S Phasge
(74) *Attorney, Agent, or Firm* — Anne B. Kiernan

(57) ABSTRACT

An electrolytic cell and system used for making nitrogen trifluoride consisting of a computer and an electrolytic cell having a body, an electrolyte, at least one anode chamber that produces an anode product gas, at least one cathode chamber, and one or more fluorine adjustment means to maintain fluorine or hydrogen in the anode product gas within a target amount by adjusting the concentration of fluorine in said anode product gas, and the process that controls the system.

14 Claims, 4 Drawing Sheets

ELECTROLYTIC APPARATUS, SYSTEM AND METHOD FOR THE SAFE PRODUCTION OF NITROGEN TRIFLUORIDE

BACKGROUND OF THE INVENTION

This invention relates to eliminating or substantially reducing the explosion hazard presented by mixtures containing nitrogen trifluoride and, in some of its more specific aspects, to reducing the explosion hazard in systems for producing, and handling nitrogen trifluoride. The invention further relates to electrolytic cells and to methods and systems in general which are especially useful for producing and handling gas mixtures containing nitrogen trifluoride.

In mixtures containing nitrogen trifluoride, e.g. gaseous or liquid mixtures such as the mixtures in systems for producing and handling nitrogen trifluoride, problems of explosions resulting from reactions between the nitrogen trifluoride and one or more of the components other than nitrogen trifluoride are presented. For example, in the production of nitrogen trifluoride by the electrolysis of a molten salt of hydrogen fluoride and ammonia, hydrogen is evolved along with nitrogen trifluoride and explosions often occur as a result of reaction between the hydrogen and nitrogen trifluoride. Problems of explosions are also presented in systems for the separation of nitrogen trifluoride from gaseous mixtures containing nitrogen trifluoride and components other than nitrogen trifluoride and in systems for carrying out reactions involving nitrogen trifluoride. Such explosions are dangerous to personnel, costly and result in production losses. Accordingly, the prevention of such explosions is of great importance.

U.S. Pat. No. 3,235,474, discloses a method to prevent explosion hazards in mixtures, e.g. gaseous or liquid mixtures containing nitrogen trifluoride by keeping the concentration of the nitrogen trifluoride in the mixture outside the range of 9.4 to 95 mol percent by diluting the mixture with diluents, hydrogen or nitrogen trifluoride. Suitable diluents are nitrogen, argon, helium and hydrogen. And U.S. Pat. No. 3,235,474 states that accordingly, a preferred method embodying the principles of this invention for eliminating or substantially reducing explosion hazards in mixtures containing nitrogen trifluoride and hydrogen comprises diluting the mixture sufficiently to maintain either the concentration of the nitrogen trifluoride at less than 9.4 mol percent or the concentration of the hydrogen at less than 5 mol percent.

Related references include JP2000104186A; JP2896196B2; U.S. Pat. No. 5,084,156; U.S. Pat. No. 5,085,752; U.S. Pat. No. 5,366,606; U.S. Pat. No. 5,779,866; US2004/0099537; EP1283280A1 and US20070215460A1. Some of these references disclose physical barriers or other physical aspects of the cell to prevent hydrogen from migrating from the cathode to the anode side of the cell. All of the references just listed and U.S. Pat. No. 3,235,474 are incorporated in their entireties herein by reference.

There still remains a need in the art for a method, electrolytic cell and system designs that reduce the explosion hazard presented by mixtures containing nitrogen trifluoride and hydrogen, particularly in the anode product gas.

SUMMARY OF THE INVENTION

This invention provides an electrolytic apparatus used for making nitrogen trifluoride comprising a body, an electrolyte, at least one anode chamber that produces an anode product gas, at least one cathode chamber, and one or more fluorine adjustment means to maintain fluorine or hydrogen in said anode product gas within a target amount by adjusting the concentration of fluorine in said anode product gas.

This invention further provides a process of controlling an electrolytic apparatus used for making nitrogen trifluoride comprising the steps of: (a) analyzing anode product gas; (b) determining if hydrogen or fluorine are present within a targeted amount in said anode product gas; and if so going to step (d) below; (c) adjusting one or more of said fluorine adjustment means to adjust the level of fluorine in said anode product gas; and (d) repeating steps (a)-(d).

This invention further provides an electrolytic system used for making nitrogen trifluoride comprising a computer and an electrolytic cell comprising a body, an electrolyte, at least one anode chamber that produces an anode product gas, at least one cathode chamber, and one or more fluorine adjustment means to maintain fluorine or hydrogen in said anode product gas within a target amount by adjusting the concentration of fluorine in said anode product gas.

This invention provides an electrolytic cell, a process and a system that provides for the operation the cell under conditions where fluorine is present in the anode product gas so that any hydrogen which might be present in the anode chamber spontaneously reacts with the fluorine and is converted to hydrofluoric acid. The danger of a deflagration is avoided since it not possible to generate a metastable mixture of higher concentrations of hydrogen and nitrogen trifluoride when fluorine is present to react with the hydrogen.

DETAILED DESCRIPTION

Figure 1:
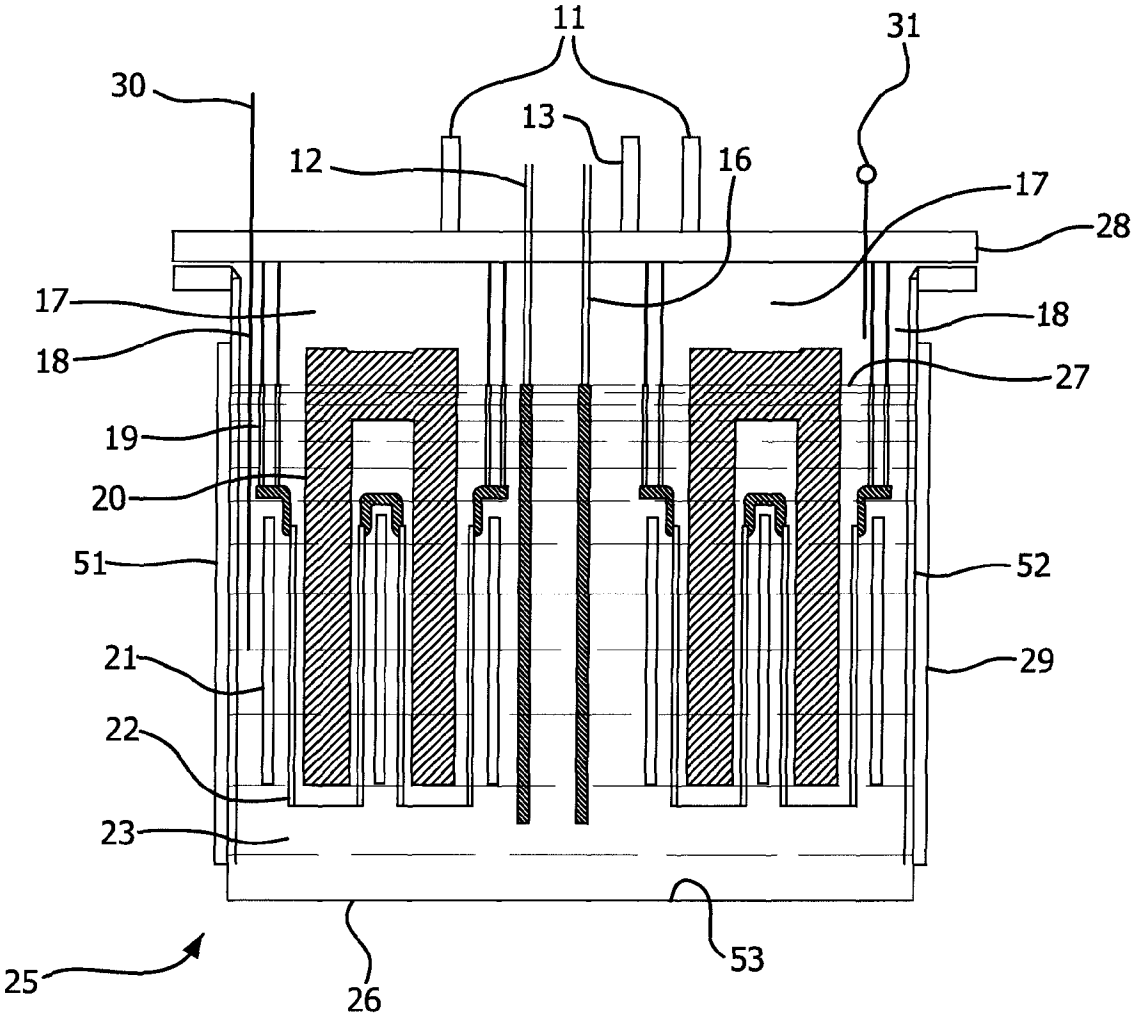
FIG. 1 is a cross-sectional view of one embodiment of an electrolytic cell useful in this invention.

This invention is related to a fluorine containing gas generation system comprising an electrolytic cell which utilizes a hydrogen fluoride (HF) containing molten salt electrolyte. The specific invention is to operate a nitrogen trifluoride ($NF_3$) gas generating electrolytic cell such that there is little or no hydrogen present in the anode product gas thereby avoiding a dangerous build up of hydrogen in the product NF3 stream. An $NF_3$ gas generating electrochemical cell also contains ammonia ($NH_3$) in the electrolyte, which reacts with HF to form ammonium fluoride ($NH_4F$). This invention provides a sufficient quantity of fluorine in the anode product gas to react with the hydrogen and thereby avoid a dangerous build up of hydrogen in the product $NF_3$ stream.

For producing nitrogen trifluoride by using the electrolytic apparatus of the present invention, the electrolyte, can be any known electrolyte that is useful in making nitrogen trifluoride, such as an hydrogen fluoride (HF)-containing molten salt of $NF_4F$ and HF (referred to as the "binary electrolyte") or an HF-containing molten salt of ($NH_4F$), KF and HF (referred to as the "ternary electrolyte"). The electrolyte in other embodiments may also contain cesium fluoride. In addition, the HF-containing molten salt electrolyte may also contain other additives such as Lithium Fluoride (LiF) for improving performance. The concentrations may be expressed in terms of mol % $NF_4F$ and HF ratio. The HF ratio is defined by the equation below:

$$HF \text{ Ratio} = \frac{\text{moles of } HF \text{ titratable to neutral } pH}{NH4F \text{ (moles)} + KF \text{ (moles)}}$$

The HF ratio represents the ratio of the solvent to salt in the electrolyte. In some embodiments with the ternary electrolyte, it may be preferable to operate the electrolytic cell with the $NH_4F$ concentration in the range of 14 wt % and 24 wt %, more preferably between 16 wt % and 21 wt %, most preferably between 17.5 wt % and 19.5 wt %; with the HF ratio preferably between 1.3 and 1.7, more preferably between 1.45 and 1.6, most preferably between 1.5 and 1.55. In other embodiments, the preferred concentration range may vary depending on the operating conditions such as applied current and electrolyte temperature. The preferred concentration range may also be different in embodiments containing the binary electrolyte. It is desirable to choose the concentration range based on a balance between high efficiency of the electrolytic cell and safe operation. Such a balance may be achieved by operating the cell with 0.5% to 5% mol $F_2$ in the anode chamber (product) gas. Operating the cell at conditions that result in the production of high fluorine concentration in the anode product gags decreases the efficiency of the cell; however, lower percentages or no fluorine in the anode product gas may represent less safe conditions.

With respect to the method for producing a hydrogen fluoride-containing binary electrolyte, there is no particular limitation, and any conventional method can be used. For example, a HF-containing binary electrolyte can be produced by feeding anhydrous hydrogen fluoride into ammonium hydrogen difluoride and/or $NH_4F$. With respect to the method for producing a HF-containing ternary electrolyte, there is no particular limitation, and any conventional method can be used. For example, a HF-containing ternary electrolyte can be produced by feeding anhydrous HF and ammonia into a mixture of KF with ammonium hydrogen difluoride and/or $NH_4F$.

This invention is not limited to any specific electrolyte composition, and any description herein referring to, for example, the binary electrolyte comprising HF and ammonia is for convenience only. It is understood that any electrolyte useful for making $NF_3$ can be substituted into the description and is included in the invention.

The electrolysis of HF-containing molten salt electrolyte comprising $NH_4F$ results in the evolution of hydrogen at the cathode and a gaseous mixture at the anode containing nitrogen trifluoride, nitrogen, and small amounts of various other impurities. In a conventional electrolytic cell, one or a plurality of anodes and one or a plurality of cathodes are employed. In some electrolytic cells for the production of $NF_3$, the cathodes are separated from the anodes by suitable means such as one or more diaphragms to prevent mixing of the hydrogen with gaseous mixture containing $NF_3$. However, even with such cells an amount of hydrogen sufficient to produce an explosive mixture can leak into the anode compartment and become mixed with the gaseous mixture containing $NF_3$ thereby forming part of the gaseous mixture. The inventors have also determined that hydrogen may also be produced in the anode chamber either by electrochemical means due to polarization of the diaphragm or by chemical means involving by-product chemistry.

The following mechanisms can account for hydrogen present in the anode product gas, which can result in a formation of a meta-stable flammable mixture. In one mechanism, hydrogen bubbles formed at the cathode can migrate from the cathode chamber into the anode chamber releasing hydrogen gas into the anode gas. This can occur when the convective electrolyte flow carries hydrogen bubbles through the diaphragm during typical operating conditions. When the cell is operated so that an excess of fluorine exists in the anode gas then any hydrogen migrating into the anode chamber will react rapidly with the fluorine to form HF.

In another mechanism, which the inventors have discovered, hydrogen can be made chemically in the anode chamber under chemical reaction conditions where the local fluorine concentration is very low and the reaction rate of fluorine with $NH_4F$ is relatively fast. In this scenario fluorine reacts rapidly with $NH_4F$ to form mono-fluoro-ammonium fluoride. Then before the mono-fluoro-ammonium fluoride can react with fluorine, it reacts with ammonium to form nitrogen and hydrogen according to Equations 1 and 2.

$$F_2+NH_4^+.F^- \rightarrow NFH_3^+.F^-+HF \qquad \text{Equation 1}$$

$$NH_4^+.F^-+NFH_3^+.F^- \rightarrow N_2+2H_2+3HF \qquad \text{Equation 2}$$

Physical barriers (for example, the diaphragm and the skirt) may help to prevent the hydrogen from traveling from the cathode to the anode side of the cell, but will not avoid the hydrogen created on the anode side from entering the anode side product gas stream.

This invention eliminates or substantially reduces the explosion hazard presented by mixtures containing nitrogen trifluoride and hydrogen in the electrolytic process, by using a hydrogen reducing means also referred to as a fluorine adjustment means. To eliminate the hydrogen from the nitrogen trifluoride anode product stream, fluorine is introduced into the anode stream so that any hydrogen that may be present therein is reacted with fluorine to form HF. The fluorine can be introduced into the gas mixture either from an external source or by producing it in the process by one or several means. the reaction of the hydrogen and the fluorine to form hydrogen fluoride removes the hydrogen from the anode product gas mixture and reduces or eliminates the explosion hazard.

The method of this invention is used to maintain the amount of hydrogen in the anode product gas stream below the explosive amount, that is, less than 5 mol % by the method of this invention. To ensure that the amount of hydrogen is present in amounts that are less than the explosive amount, the amount of hydrogen may be maintained so that it is present at less than 4 mol %, less than 3 mol %, less than 2 mol %, less than 1 mol % or in non-detectable quantities. Further, because any fluorine present will react with any hydrogen present in the anode product gas stream, it may be preferred to operate the method so that the anode product gas stream always has a detectable quantity of fluorine present therein, such as between from 0.1 to 10 mol %, or from 0.1 to 5 mol %, or from 0.5 to 5 mol %. It is particularly desirable to use the detection of fluorine in the anode product gas when the composition of the anode product gas stream is not continuously monitored, and/or because it may take some time for the composition of the anode product gas to adjust to any change in the fluorine adjusting means. Although the composition of the anode product gas may be continuously or non-continuously monitored, in some embodiments it is sufficient to monitor the composition of the cells at a time interval that may vary from 1 to 24 or from 1 to 12 or from 2 to 6 hours. The time interval for monitoring the composition of the anode product gas may be selected based on for example: the availability of analytical equipment for determining the composition, the time the analytical equipment takes to determine the composition and the approximate time it takes for the cell to reach steady-state after a change in any of the fluorine adjusting means, such as, temperature, current, electrolyte composition or addition of fluorine gas into the anode chamber or anode product gas.

To ensure that there is little or no hydrogen present in the anode product gas stream, in one embodiment, the method may be operated so that the cell operates in such a way that the cell produces a measurable amount of fluorine in the anode process stream at all times. This may be achieved by adjusting one or more of the fluorine adjusting means which include adjusting the composition of the electrolyte via one or more feed flow controllers, adjusting the temperature via one or more temperature adjusting means, adjusting the current via one or more current controllers and introducing fluorine into the cell or the anode product gas stream via one or more fluorine gas supplies. The inventors have determined that if there is too much hydrogen present and/or not enough fluorine present in the anode product gas stream, the adjusting of the fluorine adjusting means may include one or more of the following in any combination: adding hydrogen fluoride to the electrolyte; decreasing the amount of ammonia in the electrolyte; lowering the operating temperature; increasing the amount of current that flows into the cell; and/or flowing a gas stream of fluorine into the cell or into the anode product gas stream, all of which will individually or collectively (or in doubles, or in triples, etc) increase the production of the fluorine by the electrochemical cell. Additionally, if there is too much fluorine present in the anode product gas stream, the adjusting of the fluorine adjusting means may include one or more of the following: reducing the amount of hydrogen fluoride in the electrolyte composition or added to the electrolyte; increasing the amount of ammonia in the electrolyte; increasing the operating temperature; decreasing the amount of current that flows into the cell; and/or reducing or stopping the flow of a gas stream of fluorine into the cell or into the anode product gas stream, all of which will individually or collectively (or in doubles, or in triples, etc) decrease the production of the fluorine by the electrochemical cell.

The inventors have determined that the rate of fluorine production is proportional to the electrical current and the rate of fluorine consumption via reaction with $NH_4F$ increases with temperature. When the temperature is too high and the current is too low, hydrogen may be present in the anode gas. On the other hand if the current is relatively high and the temperature is too low then fluorine will be present in high concentrations in the anode gas. While this operation can be considered safe it is not efficient for the production of nitrogen trifluoride. There exists a unique set of operating conditions consisting of current and temperature where fluorine is present in the anode gas at levels between 0.5 mol % and 5 mol %. This composition of fluorine provides a safety buffer which will consume any hydrogen formed from chemical reaction or present through migration into the anode chamber.

According to the present invention, there is provided an electrolytic apparatus for producing nitrogen trifluoride by electrolyzing a hydrogen fluoride-containing molten salt electrolyte at an applied current density that is generally in the range of 10 to 200 mA $cm^{-2}$; or from 30 to 150 mA $cm^{-2}$, or from 60 to 120 mA $cm^{-2}$, which comprises: an electrolytic cell which is partitioned into one or more anode chambers and cathode chambers by one or more partition walls between each anode chamber and cathode chamber. The partition walls comprise a solid gas separation skirt, typically a solid material, and a porous diaphragm. The diaphragm is perforated or woven. Each anode chamber comprises one or more anodes, and each cathode chamber comprises one or more cathodes. The electrolytic cell has at least one feed pipe or inlet for feeding thereto a hydrogen fluoride-containing molten salt as an electrolysis liquid or raw materials for the hydrogen fluoride-containing molten salt electrolyte and controls and/or valves for those feed pipes to control the flow of the feed or individual components of the electrolyte therethrough. The anode chamber has one or more anode gas outlet pipes for withdrawing gas from the anode chamber of the electrolytic cell, and the cathode chamber has one or more cathode gas outlet pipes for withdrawing gas from the cathode chamber of the electrolytic cell.

FIG. 1 shows a schematic representation of the principal parts of the electrolytic cell apparatus for the production of nitrogen trifluoride comprising product gas. The electrolytic cell apparatus comprises an electrolytic cell 25 having an electrolyzer body 26 and an upper lid or covering 28. The cell 25 is partitioned into anode chambers 17 and cathode chambers 18 by vertically disposed gas separation skirt 19 and diaphragm 22. Anodes 20 are disposed in the anode chambers 17, and cathodes 21 are disposed in the cathode chambers 18. (In this embodiment, the electrolytic cell 25 contains a hydrofluoric acid and ammonia containing molten salt electrolyte 23.) The level 27 of electrolyte 23 is the height of the electrolyte above the bottom surface 53 of the electrolytic cell 25. The electrolytic cell 25 has feed tubes 12 and 16 for feeding raw materials or the components that make up the electrolyte 23. As shown in FIG. 1, feed tube 12 is a HF feed tube 12 and feed tube 16 is an ammonia feed tube 16. In other embodiments, one or both of the feed tubes 12 and 16 may also be used to directly feed thereto a pre-mixed HF and ammonia containing molten salt electrolysis liquid. In general, the feed tubes 12 and 16 are provided in the cathode chamber 18. The anode chamber 17 has an anode product outlet pipe 11 for withdrawing the $NF_3$ containing product gas mixture from the electrolytic cell 25. The cathode chamber 18 has a cathode product outlet pipe 13 for withdrawing gas from the electrolytic cell 25. If desired, the electrolytic apparatus of the present invention may further comprise additional components such as purge gas pipe connections in the anode and cathode chambers. A purge gas source 48 (as shown in FIG. 2), such as nitrogen for example, may be connected to the anode chamber 17 and/or the cathode chamber 18 (not shown) of the electrolytic cell to provide for a purge of the electrolytic cell for safety reasons or to provide a blow-out means for clogged pipes or to otherwise provide for the proper functioning of the inlet and outlet tubes and pipes and other instrumentation.

When the cell of this embodiment is operated, the nitrogen trifluoride containing gas is generated at the anode and the hydrogen is generated at the cathode. The gases generated at the anode chamber may comprise nitrogen trifluoride ($NF_3$), Nitrogen ($N_2$) and fluorine ($F_2$). In addition, HF has a vapor pressure over the electrolyte 23 and is therefore present in the gas leaving both the anode chamber 17 and cathode chamber 18.

Figure 2:
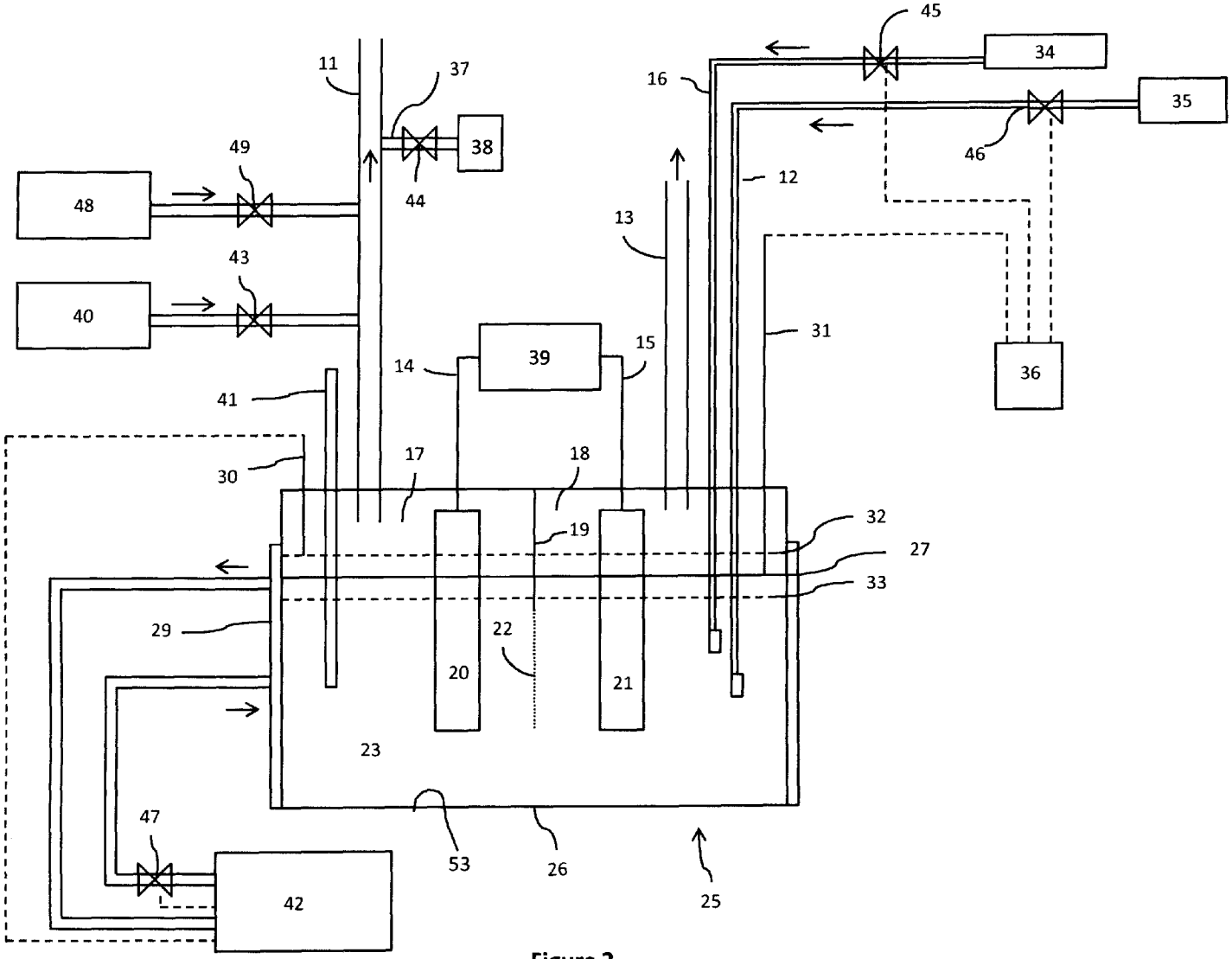
FIG. 2 is a cross-sectional view of another embodiment an electrolytic cell useful in this invention.

FIG. 2 shows a cross sectional view of an electrolytic cell similar to the one shown in FIG. 1 except that the cell 25 shown in FIG. 2 comprises only one anode chamber 17 and one cathode chamber 18. The anode chamber 17 has one anode 20 and the cathode chamber 18 has one cathode 21. The cell shown in FIG. 2 also differs from the cell shown in FIG. 1, because it shows additional components not shown in FIG. 1, that a cell that is useful in this invention may comprise, particularly many of the various measurement and fluorine adjusting means. Like components in FIGS. 1 and 2 are numbered the same.

The cell 25 shown in FIG. 2 comprises a current controller 39 that supplies current to the anode 20 through anode current connection 14 and to the cathode 21 through cathode current connection 15 at a level that can be increased or decreased within a target range specified by the operator or the control process for the electrolytic cell. The current controller 39 by increasing or decreasing the current provided to the anode and cathode is one of the fluorine adjusting means of this invention.

The cell shown in FIG. 2 comprises a means to measure the level or level indicator 31 of the electrolyte which as shown in FIG. 2 communicates with an electrolyte feed flow controller 36. The flow controller 36 also communicates with and controls flow control valve 46 which is in communication with a HF source 35 and communicates with and controls flow control valve 45 which is in communication with an ammonia source 34. As electrolysis proceeds and the molten salt electrolyte become depleted, the level indicator 31 signals the feed flow controller 36 that the electrolyte needs to be replenished. The electrolyte feed flow controller communicates to the flow control valves and has ammonia and HF fed into the molten electrolyte from an ammonia source 34 using a flow control valve 45 and a HF source 35 using a flow control valve 46 respectively. The flow control valve 45 can be used to adjust the feed rate of ammonia from ammonia source 34 based on the consumption rate of the ammonia to form nitrogen trifluoride containing gas. The composition rate of the ammonia and the other components in the electrolyte may be obtained from mass balance involving product gas composition and product gas flow.

The level of the electrolyte is the height of the electrolyte above the bottom surface 53 of the cell 25. There may be one or more level indicators or detectors in a cell, for example, one each in the anode chamber and the cathode chamber to account for the differential pressure that may exist between the two chambers that causes two separate electrolyte levels. The level detectors may be based on any of the different methods available such as current conduction or gas bubbler system. The electrolyte level is set to an appropriate value taking into account the geometry of the electrolytic cell and the operating conditions of the electrolytic cell. The electrolyte level is adjusted by feed flow controller 36 which controls the flow of the electrolyte feed into the cell. The electrolyte feed flow controller 36 controls the valve 46 that controls the flow of HF from a HF source 35 to the electrolytic cell apparatus 25 and controls the valve 45 that controls the flow of ammonia from the ammonia source 34 to the cell 25. The electrolyte feed flow controller 36 takes into consideration the level of the electrolyte in the cell prior to adding electrolyte feed to the cell. The level indicator 31 communicates the level to the electrolyte feed flow controller 36. Typically, the electrolyte level has a pre-determined (maximum) high level set point 32 and a low level set point 33. When the level goes below the pre-determined (minimum) low level set point 33, there is a possibility of the anode product gas and cathode product gas to mix resulting in an explosive mixture. If the level goes above the pre-determined high level set point 32, this may lead to problems such as improper gas-liquid separation, electrolyte carryover into the anode or cathode outlet pipe and enhanced corrosion of the cell components. The electrolyte feed flow controller 31 will have feed added to the cell if the level falls below the target level. In accordance with this invention, the electrolyte feed flow controller may also be used to adjust the flow of electrolyte feed into the cell and level of the electrolyte in the cell to adjust the fluorine in the anode product gas.

Adjusting the composition of electrolyte uses the electrolyte feed flow controller 36. In the embodiment shown in FIG. 2, the electrolyte feed flow controller 36 comprise separate flow control valves for adjusting the flow of the HF and the ammonia. The composition of the electrolyte is a fluorine adjusting means of this invention. The cell 25 shown in FIG. 2 comprises an electrolyte sample port 41 for obtaining a sample of the electrolyte 23 that is useful for determining the composition of the electrolyte 23 and may be useful in the method of this invention for determining which fluorine adjusting means to adjust. If, in the process of this invention, the composition of the electrolyte is to be adjusted to result in the production of more or less fluorine from the anode chamber, the electrolyte feed flow controller may be used to adjust the flow of HF and/or the ammonia into the cell to adjust the production of fluorine by the cell. The electrolyte composition may also be adjusted by manually adjusting to adjust the flow of HF and ammonia (the electrolyte feed components) into the cell via valves 45 and 46.

A temperature detector 30 is provided in the cell for measuring the temperature of the electrolyte 23. The temperature detector may be a thermocouple, or other direct or indirect, contact or non-contact, temperature measuring means known in the art. The cell is provided with a temperature adjusting means 29 which may be a heat transfer fluid jacket disposed around and/or in contact with at least part of the outer surface of the cell. As shown the temperature adjusting means 29 may be attached to the side faces 51, 52 of the electrolytic cell to heat and/or cool the cell 25. As shown the heat transfer fluid jacket circulates heated or room temperature or cooled heat transfer fluid depending on if the temperature of the electrolyte is to be increased or decreased; that is if the cell, particularly the electrolyte therein, is to be heated or cooled. The heat transfer fluid may be any fluid that is considered suitable to be used for the purposes described herein, for example, water, glycol and mineral oil. In some embodiments, not shown in the figure, alternatively or additionally, the temperature adjusting means may comprise heat transfer tubes having a circulating heating or cooling medium that may be present inside the electrolytic cell 25 below the electrolyte level and/or are embedded in the bottom or side walls of the cell body. Alternatively, other heating means or cooling means may be used, for example resistive heaters, air blowers and others known to the art. The flow of the heat transfer fluid is controlled by the electrolyte temperature controller 42 which may comprise a pump, a heater and a cooling means, which are not shown in the figure. The electrolyte temperature controller 42 receives input from the temperature detector 30 and may automatically adjust or maintain the operation of the temperature adjusting means 29 in response to the temperature of the electrolyte in response to that temperature reading. Adjusting the temperature of the electrolyte via the temperature adjusting means 29 may alternatively be done manually. The temperature adjusting means in the embodiment shown may open or close valve 47 to cause more heating or cooling fluid to flow or may cause a heater to increase the temperature of the heat transfer medium or may cause the heater to stop heating the heat transfer medium to decrease its temperature and thereby the temperature of the electrolyte. Adjusting the temperature of the electrolyte is a fluorine adjusting means used to adjust the amount of hydrogen (if present therein) and fluorine in the anode product gas.

In the electrolysis performed in the present invention, with respect to the temperature of the electrolyte 23, the low end of the operating temperature range for the electrolyte is the minimum temperature needed to maintain the electrolyte in a molten state. The minimum temperature needed to maintain the electrolyte in a molten state depends on the composition of the electrolyte. In some embodiments, the temperature of the electrolyte 23 is typically from 85 to 140° C. or from 100 to 130° C.

The cell has a gas separation skirt 19 and the diaphragm 22 positioned vertically between the anode and cathode chambers to prevent the NF containing anode product gas from being mixed with hydrogen containing cathode product gas during electrolysis. The cell also has a gas composition analyzer 38 that is shown in fluid communication via an anode gas sample port 37 and a flow control valve 44 with the anode product outlet pipe so that samples of the anode product gas may be taken and analyzed. Typically the samples of the anode product gas will be taken at certain time intervals and not continuously; however, they may be taken continuously if the equipment is available. The analysis of the anode product gas may be used in the method of this invention to determine if one of the fluorine adjusting means needs to be adjusted.

Any material may be used to construct the components of the cell so long as the materials are durable when exposed to the corrosive conditions of the cell. Useful materials for the cell body, separation skirt and diaphragm are iron, stainless steel, carbon steel, nickel or a nickel alloy such as Monel®, and the like, as known to a person of skill in the art. The material(s) of construction for the cathode 21 is not specifically limited so long as the cathode is made of a material which is useful for that purpose as known to a person of skill in the art, such as nickel, carbon steel and iron. The material(s) of construction for the anode 20 is not specifically limited so long as the anode is made of a material that is useful for that purpose, such as nickel and carbon. Additionally, all of the other components of the electrolytic cell may be selected from those that are known to be used in electrolytic cells that are used for electrolyzing a HF-containing molten salt.

Figure 3:
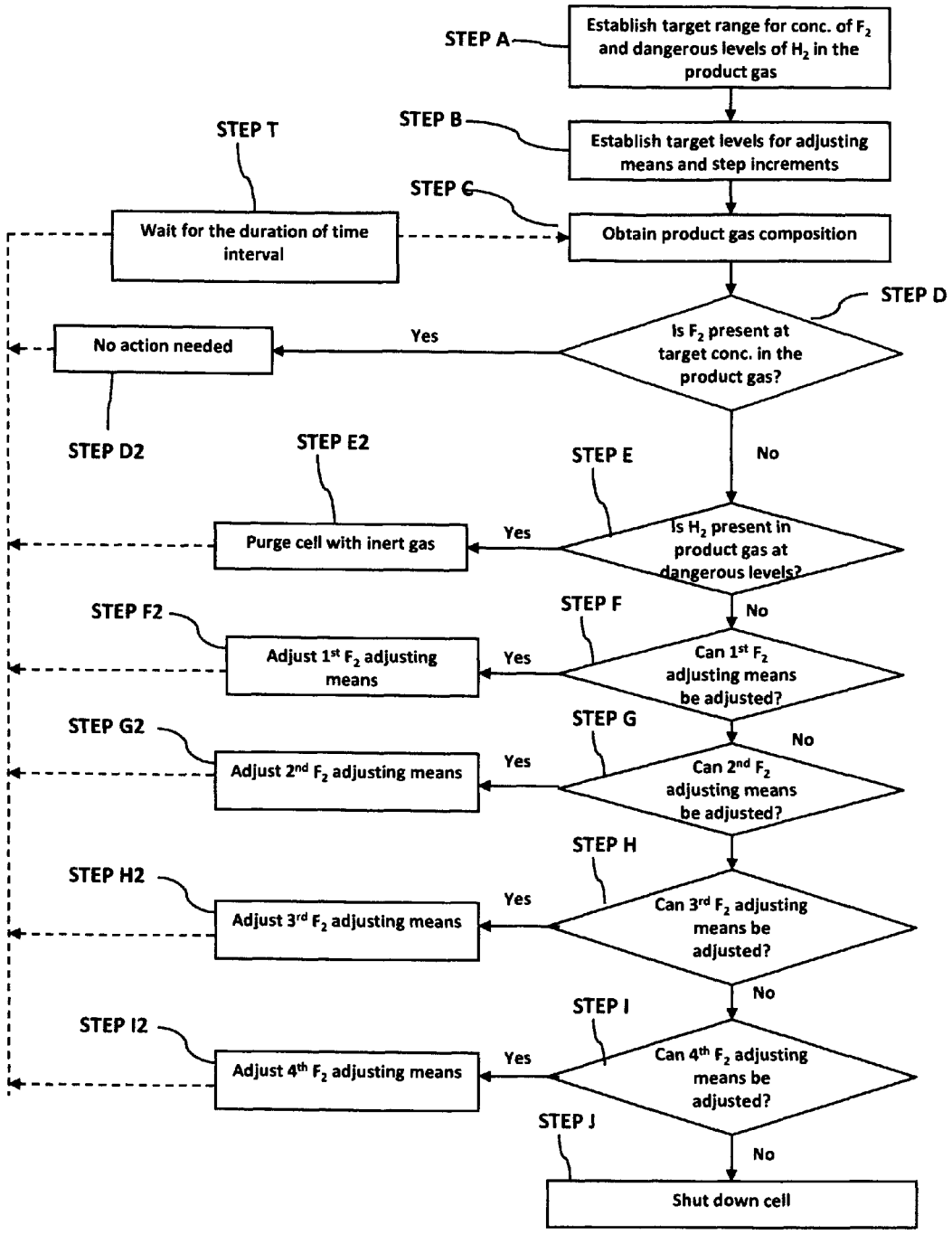
FIG. 3 is a flow chart showing the process steps of one embodiment of a process of this invention.

One embodiment of the method of this invention by which the concentration of fluorine (and thereby the hydrogen) in the anode product gas mixture can be controlled is shown in FIG. 3. For the embodiments that are shown in the figures or otherwise described herein, the process steps may all be performed automatically by machine or a computer controlled means or all the process steps may be performed manually by one or more operators. For other processes of the invention, some of the steps will be performed automatically by a machine or computer means and others will be manually performed by an operator. Although not shown in the figures, this invention contemplates and includes an electrolytic cell that is part of a completely computer controlled system for the electrolytic cell, in which all of the measurements described herein (for example, electrolyte temperature, anode product gas composition, electrolyte composition, electrolyte level, etc) are communicated to a computer and an algorithm will automatically control the fluorine adjusting means.

The first step shown in FIG. 3 is step A which is to establish the acceptable target value which may be a single number or a range, typically a range, for the hydrogen and/or the fluorine concentration in the anode product gas. In this embodiment, to try to ensure that the system is operating with little or no hydrogen in the product gas stream, the amount of fluorine in the product stream will be an amount that can be measured. It is desirable to try to operate the electrolytic cell so that a detectable level of fluorine is present in the anode product gas stream at substantially all times (whenever detected or at least greater than 95% of the time), or at all times to ensure the level of hydrogen is in the safe range and/or not present at substantially all times or at all times. When the concentration of fluorine in the anode product gas is measured and compared to a target, the target for the fluorine concentration in the anode product gas may be, for example, between from 0.5 mol % to 5 mol % or between from 0.5 mol % to 3 mol % or between from 1 mol % to 2 mol %. The target values for hydrogen could be, for example, less than 5 mol %, or less than 4 mol %, or less than 3 mol %, or less than 2 mol %, or less than 1 mol %, or 0 mol %.

Step B is to establish the target levels for the fluorine adjusting means that will be used in the process particularly if there are minimum and maximum values above which it is not desirable to adjust the fluorine adjusting means above or below. For the process shown in FIG. 2, since first, second, third and fourth fluorine adjusting means are used in the process, then target levels for the first to fourth fluorine adjusting means may be determined for the electrolytic cell to be controlled. For the electrolyte composition, in some embodiments with ternary electrolyte, the electrolytic cell may be operated with the $NH_4F$ concentration in the electrolyte in the range of 14 wt % and 24 wt %, or in the range of 16 wt % and 21 wt %, or in the range of 17.5 wt % and 19.5 wt %; and the HF ratio may be between 1.3 and 1.7, or between 1.45 and 1.6, or between 1.5 and 1.55. In other embodiments, the concentration range will vary dependent on the cell characteristics including the operating conditions, such as size, applied current and electrolyte temperature. The preferred concentration range may also be different in embodiments containing binary electrolyte. It is desirable to choose the concentration range of the electrolyte to achieve a balance between high efficiency of the electrolytic cell and safe operation, which in one embodiment includes operating the cell with 0.5 mol % to 5 mol % $F_2$ in the anode product gas. This level is set by an operator or engineer familiar with the operation of electrolytic cells. Additionally, in Step A, for safety, the dangerous levels for hydrogen or fluorine are defined in advance to trigger an immediate cell shut down and purge with inert gas if those levels are measured in the anode product gas. For hydrogen the level may be equal to or greater than 5 mol % of the anode product gas.

The target levels for the temperature and current may also be determined. For example, the temperature may be operated within the range from 85 to 140° C. and the current from 10 to 200 mA $cm^{-2}$. If fluorine introduced into the anode product gas or the anode chamber (from an external source) is to be used as a fluorine adjusting means the target flow rate of the fluorine may be a single target value or a range. If there are other fluorine adjusting means that are going to be used in the process, their target values should be determined. The target values which may be ranges for the fluorine adjusting means should be determined and either entered into the automatic control system or otherwise recorded or catalogued for an operator to refer to. Also the step increments for the increase and decrease in the fluorine adjusting means for each of the fluorine adjusting means should also be determined and entered into the automatic control system or otherwise recorded or catalogued for an operator to refer to. Note that the step increments for the change in the fluorine adjusting means may be a set amount or may be a variable amount depending upon the conditions in the cell, for example, the amount that the fluorine measured in the anode product gas is away from the target amount for the fluorine. The larger the amount that the fluorine or hydrogen is away from the target amount, the larger the step increments for changing the fluorine adjusting means. The target levels and the step increments can be determined in advance by an operator or engineer familiar with the operation of the type of electrolytic cell to be controlled.

The next step, Step C is to measure the composition of fluorine and hydrogen in the anode product gas ($NF_3$ gas mixture) which can be done, as shown in FIG. 2 by opening valve 44 and using gas composition analyzer 38. The gas composition analyzer may be a UV-visible spectrometer or gas chromatograph. The composition of the anode product gas can be obtained more frequently with certain techniques such as UV-visible spectroscopy and Fourier Transform Infrared spectroscopy (FTIR) (minutes), or less frequently with certain techniques such as gas chromatography (GC).

Note that this invention anticipates and includes the determination of components by indirect measurements. For example, since fluorinated compounds damage a typical GC column, the hydrogen fluoride and fluorine are sent through an absorbent, such as calcium oxide, to remove them from the anode gas. The adsorption of fluorine and HF produce oxygen and water, respectively. The oxygen becomes a part of the analyte while the water is adsorbed. The GC analysis provides the volumetric percentages of each gas in the anode effluent analyte stream. Since hydrogen fluoride and fluorine cannot be analyzed by GC, they are each analyzed in a separate stream. FTIR analysis provides the volumetric percentage of HF in the anode effluent, while UV-visible spectrometer provides the volumetric percentage of $F_2$. The volumetric percentage of oxygen, produced solely by the absorbent, can also be related to the volumetric percentage of fluorine using the reaction stoichiometry.

If the concentration of fluorine (and/or hydrogen) in the gas mixture, determined in Step C is within the target amount, then no further action is needed as indicated by Step D2 and the process follows the arrows shown in FIG. 3 to Step T, which is the time interval step, a waiting period, before which Step C and one or more steps of the process are repeated and/or performed. The typical time interval is from 1 to 24 or from 1 to 12 or from 2 to 6 or from 1 to 2 hours until the process is repeated again. The time interval may be a set or variable amount. For a continuous process, Step T would be eliminated or set to 0. (Note Steps A and B are typically not repeated every time through the process of the invention, but may be repeated if the target amounts need to be adjusted due to conditions in the electrolyte or in the environment that require those target values to be changed.)

If the concentration of hydrogen and/or fluorine are not present in the anode product gas within the target range, then the measured amount of fluorine and hydrogen are compared to the previous defined dangerous amounts of hydrogen or fluorine in Step E. If fluorine or dangerous amounts of hydrogen are present, in Step E2, valve 49 to the inert gas source 48 in FIG. 2 is opened and the anode chamber and anode product gas of the electrolytic cell is flushed and diluted with an inert gas. Alternatively or additionally in other embodiments (not shown), the cell may be shut down (current application and heating (if on) are shut off) and optionally an alarm may be sounded to alert an operator.

If the answer to the question asked in Step E is no and the cell is operating such that there is not a dangerous level of hydrogen and/or fluorine, then in Step F, the process will look to the first fluorine adjusting means to see if it can be adjusted to adjust the amount of fluorine in the anode product gas. For example, if the fluorine level is too low, then depending upon which fluorine adjusting means is the first fluorine adjusting means, it will have to be adjusted up or down to increase the fluorine level in the anode product gas. To determine if the first fluorine adjusting means can be adjusted in the direction and amount necessary to affect the concentration of fluorine in the anode product gas (in this example increase the concentration of fluorine in the anode product gas), the target range inputted in Step B of the first fluorine adjusting means is compared to the present value for the first fluorine adjusting means. Part of Step F of the process is measuring or otherwise determining the present value for the first fluorine adjusting means. The present value for the first fluorine adjusting means is then compared to the target range for the first fluorine adjusting means determined in Step B to determine if the first fluorine adjusting means can be adjusted in the direction necessary to affect the change to the fluorine in the anode product gas. If so, then the first fluorine adjusting means is adjusted in Step F2 by the step increment and the process moves to Step T and then Step C and other steps are repeated or performed for the first time (as shown in FIG. 3) when the process is repeated.

If at any time through the process, Steps D and Step E are both "No" and if the first fluorine adjusting means at any time through the process cannot be adjusted, which may occur after the first fluorine adjusting means has been adjusted one or more times through the process (or maybe not at all), because to do so would result in the first fluorine adjusting means being outside the target range for the first fluorine adjusting means in Step F, then the process moves to Step G. In Step G, the second fluorine adjusting means is analyzed in the same way as the first fluorine adjusting means was in Step F to determine if it can be adjusted. The present value of the second fluorine adjusting means is measured (or otherwise determined) and compared to the target value for the second fluorine adjusting means. If the second fluorine adjusting means can be adjusted and still stay within the target value for the second fluorine adjusting means, then the process proceeds to step G2, the second fluorine adjusting means is adjusted by a step increment and the process proceeds to Step T, then to Step C and repeats.

If at any time through the process, Steps D, and E are both "No" and if the first and second fluorine adjusting means at any time through the process cannot be adjusted (again it may be after the first and second fluorine adjusting means have each been adjusted one or more times or maybe not at all), because to do so would be outside the target ranges for the first and second fluorine adjusting means in Step F and Step G, then the process moves to Step H. In Step H, the third fluorine adjusting means is analyzed in the same way as the first and second fluorine adjusting means in Step F and G (present value is measured and compared to target) to determine if the third fluorine adjusting means can be adjusted. If the third fluorine adjusting means can be adjusted then the process proceeds to step H2, the third fluorine adjusting means is adjusted and the process proceeds to Step T, then Step C and repeats.

If at any time through the process, Steps D and E are both "No" and if the first, second and third fluorine adjusting means at any time through the process, (it may be after the first, second and third fluorine adjusting means have each been adjusted one or more times or maybe not at all), and presently none of the first, second, and third fluorine adjusting means can be adjusted, because to do so would be outside the target ranges for the first, second and third fluorine adjusting means in Step F, G, and H then the process moves to Step I and the fourth fluorine adjusting means is analyzed in the same way as the first, second and third fluorine adjusting means in Step F, G, and I, to determine if the fourth fluorine adjusting means can be adjusted. If the fourth fluorine adjusting means can be adjusted then the process proceeds to step 12, the fourth fluorine adjusting means is adjusted and the process proceeds to Step T, then Step C and repeats.

If at any time through the process, Step D and Step E are both "No" and if the first, second, third and fourth fluorine adjusting means at any time through the process, and it may be after the first, second, third and fourth fluorine adjusting means have each been adjusted one or more times or maybe not at all, are such that presently none of them can be adjusted, because to do so would be outside the target ranges for the first, second, third and fourth fluorine adjusting means in Step F, G, H and I, then the process moves to Step J which is to notify the operator and/or to shut down the cell and/or purget the cell with an inert gas.

The first fluorine adjusting means, second fluorine adjusting means, third fluorine adjusting means, and fourth fluorine adjusting means may be any of the following selected in any order: (a) adjusting the amount of hydrogen fluoride in the electrolyte; (b) adjusting the amount of ammonia in the electrolyte; (c) adjusting the temperature of the electrolyte; (d) adjusting the amount of current applied to the cell; (e) adjusting the flow of a gas stream of fluorine into the cell or into the anode product gas stream, all of which will individually or collectively change the production of the fluorine by the electrochemical cell. The first fluorine adjusting means may be independently selected from (a), (b), (c), (d) or (e). The second fluorine adjusting means may be independently selected from (a), (b), (c), (d) or (e). The third fluorine adjusting means may be independently selected from (a), (b), (c), (d) or (e). The fourth fluorine adjusting means may be independently selected from (a), (b), (c), (d) or (e). The first to fourth fluorine adjusting means should be different. Although not shown, the process shown in FIG. 3 and described above may comprise fewer steps than shown, meaning it may comprise only a first fluorine adjusting means (and not steps G, H, and I); or it may comprise a first fluorine adjusting means and a second fluorine adjusting means (and not steps H and I) or it may comprise a first fluorine adjusting means, second fluorine adjusting means and third fluorine adjusting means (and not Step I). The fluorine adjustment means for these processes are each independently selected as described. Alternatively the process may include a fifth fluorine adjusting means that is adjusted as described above for the other fluorine adjusting means. The fifth fluorine adjusting means may be independently selected from (a), (b), (c), (d) or (e) and should differ from the first through the fourth fluorine adjusting means.

For example for the process shown in FIG. 3, if Step D and E are "No" but the fluorine amount in the anode product gas is too high and if the first fluorine adjusting means is the temperature, the temperature will be measured via the temperature detector 30, and compared to the target operating range for the temperature to determine if it can be increased, and if so, the temperature will be increased by some incremental step amount, for example an amount between 1° C. and 5° C. and then the process will proceed to Step T, and eventually Step C and the rest of the process steps will be repeated after the set time interval has passed. Note, the incremental step amount may be a set amount or may be a variable amount determined by a computer program or an operator based on the measured amount of fluorine in the anode product gas and/or based on the target range for the first fluorine adjusting means. If on the other hand, the fluorine level in the anode product gas is too low, and the first fluorine adjusting means is the temperature, the temperature will be decreased by some increment if the low end of the predetermined target range for the temperature is below the measured temperature thereby allowing the temperature to be decreased by a set or variable incremental step amount and still stay within the target range for the temperature for the process. If the temperature can be decreased it will be and then the process will proceed to Step T and then to Step C and repeated.

The inventors have determined that if there is too much hydrogen present and/or not enough fluorine present in the anode product gas stream, the fluorine adjusting means may include one or more of the following: adding HF to the electrolyte; decreasing the amount of ammonia in the or added to the electrolyte; lowering the operating temperature; increasing the amount of current that flows into the cell; and/or flowing a gas stream of fluorine into the cell or into the anode product gas stream, all of which will individually or collectively increase the production of the fluorine by the electrochemical cell or increase the fluorine available to react with the hydrogen. On the other hand, if there is too much fluorine present in the anode product gas stream, the fluorine adjusting means may include one or more of the following: reducing the amount of hydrogen fluoride in the or added to the electrolyte; increasing the amount of ammonia in the or added to the electrolyte; increasing the operating temperature; decreasing the amount of current that flows into the cell; and/or reducing or stopping the flow of a gas stream of fluorine into the cell or into the anode product gas stream, all of which will individually or collectively decrease the production of the fluorine by the electrochemical cell. In some embodiments of this invention it may desirable to adjust more than one of the fluorine adjusting means in response to a measurement of the fluorine in the anode product gas that is not within the target range. Note that any combination of the fluorine adjusting means (a) to (e) listed above may be adjusted together in a single step in the process in response to a measurement of the fluorine in the anode product gas that is not within the target range. Also, in other embodiments of the process it may be desirable to adjust a first fluorine adjusting means, the first time that the fluorine or hydrogen is outside of the target range and then adjust a second fluorine adjusting means the next time the fluorine or hydrogen is outside of the target range instead of adjusting the first fluorine adjusting means possibly multiple times until it cannot be adjusted again and still stay within the target amount for the first fluorine adjusting means.

Figure 4:
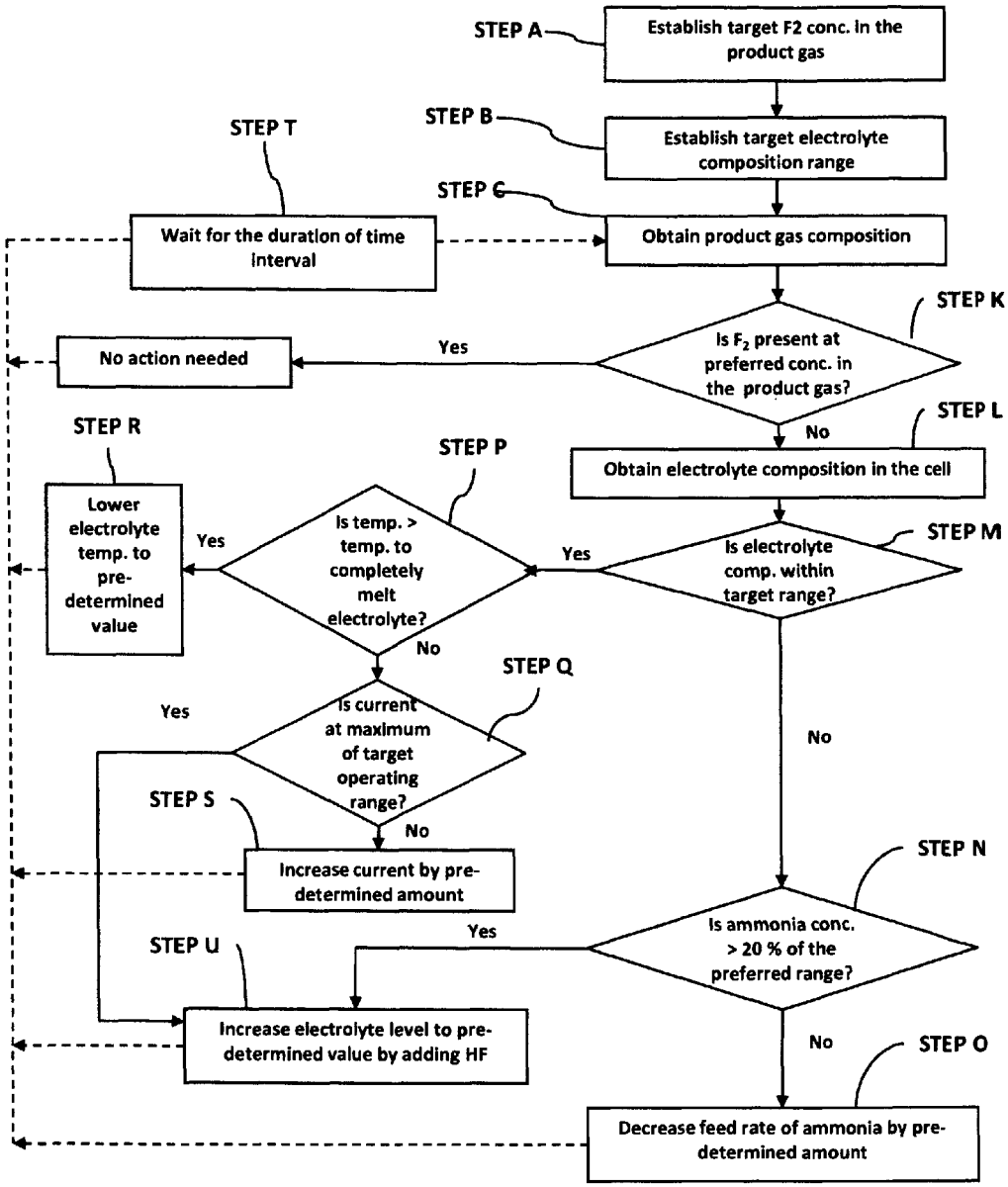
FIG. 4 is a flow chart showing the process steps of another embodiment of a process of this invention.

Referring to the flowchart in FIG. 4, another embodiment of the process of controlling the concentration of fluorine in the anode product gas mixture is shown. Step A is to establish the target value which may be a range for the fluorine concentration in the anode product gas. The concentration of fluorine in the anode product gas may be from 0.5 mol % to 5 mol % or from 0.5 mol % and 3 mol % or from 1 mol % and 2 mol %. Step B is to establish the preferred electrolyte concentration value which can be a range. In some embodiments with ternary electrolyte, the range for the operation of the electrolytic cell may be: the ammonium fluoride concentration in the range of 14 wt % to 24 wt %, or from 16 wt % to 21 wt %, or from 17.5 wt % to 19.5 wt %; with the HF ratio from 1.3 to 1.7, or from 1.45 to 1.6, or from 1.5 to 1.55. In other embodiments, the preferred concentration range may vary depending upon the operating conditions such as applied current and electrolyte temperature. Also, in embodiments containing binary electrolyte the concentration ranges may be different. It is desirable to choose the concentration range based on both high efficiency of the electrolytic cell and safe operation, which includes operating the cell, in some embodiments, with 0.5 mol % to 5 mol % $F_2$ in the anode chamber gas.

The values determined for Steps A and B may be inputted into a computer for an automatically controlled process or into an operator's manual for a manually controlled process or into both for a partially computer and partially manually controlled process. As with the previously described embodiment, the control steps may be performed automatically by computer controlled means and/or manually by one or more operators or some combination of automatic and manual control.

The composition of fluorine in the $NF_3$ gas containing anode gas mixture is obtained in Step C from anode gas sample port 37 containing valve 44 using gas composition analyzer 38 which may be any known in the art, such as, UV-visible spectrometer or gas chromatography. The composition of the anode gas may be measured more frequently with certain techniques such as UV-visible spectroscopy and Fourier Transform Infrared spectroscopy (FTIR) or less frequently with certain techniques such as gas chromatography (GC). Step K is next and checks if the concentration of fluorine in the gas mixture is in the target range or at the target value. If so, then no further action is needed and the process will go to Step T and wait for a period of time (which may be no time for a continuous process) until Step C and the rest of the process is repeated. (Note Steps A and B are typically not repeated every time through the process of the invention, but may be repeated if the target amounts need to be adjusted due to conditions, for example, in the electrolyte or in the environment that require those target values to be changed.)

If in Step K the concentration of fluorine in the anode gas is lower than 0.5 mol %, then the process proceeds to Step L and an electrolyte sample is collected from electrolyte sample port 41 and the hydrogen fluoride and ammonium fluoride concentration in the electrolyte is measured using methods known in the art, such as, acid-base titration or ion chromatography. If in Step M, the ammonium fluoride and the hydrogen fluoride concentration are within the preferred composition range as discussed above, then the process moves to Step P. In Step P the temperature of the electrolyte is measured using temperature detector 30, and compared to the minimum temperature for the electrolyte at which the electrolyte is completely molten. If the electrolyte is above the minimum temperature, then the amount of fluorine in the anode gas mixture can be increased by lowering the temperature by a few degrees in Step R, for example between 1° C. and 15° C. using temperature controlling means 42. In some embodiments, it may be preferable to lower the temperature between 2° C. and 10° C. and more preferably between 2° C. and 5° C. Then, the process proceeds to Step T, to wait for a period of time before repeating the process. The time period may be selected to provide sufficient time for the cell to reach steady state or near steady state at which time the process is repeated to recheck the fluorine level in the anode product gas and perform other steps of the process as determined by the values of measured variables and different process steps based on those values.

On the other hand, if the temperature of the electrolyte is near the minimum temperature at which the electrolyte is completely molten, for example, less than 1° C. above the minimum temperature, then from Step P the process will proceed to Step Q and check if the current through the cell is below the maximum allowable value for the current through the cell. If the current is below the maximum value of the target operating range then in Step S, the current is increased by the current controller 39 typically from 10 to 300%, or from 10% to 200%, or from 10 to 100% or up to the maximum target current value whichever is lower. After increasing the current, the process continues with Step T and waits the time interval before repeating at least Steps C and K again.

If, on the other hand, the current is at the maximum of the target operating value, the process proceeds to Step U, and the amount of fluorine in the product gas can be increased by increasing the amount of HF in the electrolyte. Increasing the amount of HF in the electrolyte increases the HF ratio of the electrolyte. When HF is added to the electrolyte the electrolyte level will increase. The electrolyte level may be increased from 0.5% to 10% of the existing level or from 0.5% to 5% or from 0.5% to 2% of the existing level, however, no electrolyte can be added if the electrolyte is at the high level set point 32 previously established based on the geometry of the cell. Before any HF or other components of the electrolyte are added to the cell, the level of the cell is determined by the level indicator 31 and the electrolyte feed flow control 36 will open valve 46 accordingly based on the process controls and the high level set point 32. After HF is added to the cell the process returns to Step T to await repeating the process again. If at Step U, the level of the electrolyte is at its maximum, an operator will be notified, although this step is not shown in FIG. 4.

Going back to Step M, if the electrolyte composition is out of the target range, the process proceeds to Step N and checks if the ammonia concentration in the electrolyte is greater than 20% outside of the target range. If so then the process goes to Step U and after checking the level of the electrolyte will add HF to the electrolyte if possible and proceed to Step T as described above. If instead the amount of ammonia is not greater than 20% of the target range for the electrolyte, the amount of fluorine in the anode gas mixture can be increased by reducing the feed rate of ammonia in Step O from the ammonia source 34. The feed rate of ammonia may be reduced between 5 to 99%. In some embodiments, it may be preferable to shut off ammonia feed to the cell completely in Step O to lessen the time it takes for the electrolyte composition to revert back to the preferred range if the electrolyte level is sufficiently above the low level for the electrolyte. In some embodiments it may take a few minutes for the electrolyte composition to achieve a new steady state in the target range for the electrolyte while in the other embodiments, it may take several hours for the electrolyte concentration to achieve a new steady state in the target range for the electrolyte. For one or more adjustments for which the time to reach a new steady-state is expected to be shorter the time interval in Step T may be decreased.

If the electrolyte composition is significantly out of range, more specifically the concentration of ammonia and/or HF are more than 20% outside of the target composition range for the cell, then it may take a long time (for example, several hours) for the composition to achieve the target range by adjusting ammonia feed alone. In this case, it may be desirable to also perform the step of increasing the amount of HF in the electrolyte by increasing the electrolyte level Step U as described above. (The process of performing Step U and Step O at the same time is not shown in FIG. 4.) As described above for Step U the maximum electrolyte level cannot be exceeded.

In other embodiments of this invention it may be desirable to perform multiple steps simultaneously to increase the concentration of fluorine in the anode product gas. For example, the temperature of the electrolyte may be reduced (like in Step R of the process shown in FIG. 4), at the same time that the ammonia feed rate (like in Step O of FIG. 4) is reduced. In another embodiment, the level set point may be increased by adding HF (like in Step U of FIG. 4) while simultaneously the feed rate of ammonia is reduced (like in Step O of FIG. 4).

In some embodiments if the fluorine level in the anode product gas needs to be increased, instead of following the steps above, it may be preferable to introduce fluorine gas via flow control valve 43 into the anode chamber from an external source 40, such as a cylinder containing fluorine or from a generator such as an electrolytic cell that produces fluorine. (The electrolyte in the electrolytic cell producing fluorine may comprise HF containing molten salt electrolyte without ammonia.) Alternatively fluorine may be introduced into the bottom of the anode chamber (not shown.)

In some embodiments, it may be preferable to add a step as shown in FIG. 3 that if a dangerous mixture in the anode product gas is measured, that is, concentrations that are well outside the target ranges, the process may include an additional step to introduce an inert gas such as nitrogen, argon, helium, sulfur hexafluoride into the anode chamber from an external source 48 with a flow control valve 49, such as a cylinder containing nitrogen, argon, helium, sulfur hexafluoride to sufficiently dilute the anode product gas to reduce the potential for the formation of a flammable mixture. In other embodiments, upon the detection of a dangerous mixture, the process will also include the steps of turning off the electrolytic cell apparatus completely while the anode product gas is purged using an inert gas and notifying an operator.

The control processes described herein may be used at start-up and shut down of the cell operation; however, they are most useful during long production runs of the cell. By using the apparatus and control processes of this invention and making small incremental adjustments to the fluorine adjusting means during the cell's operation, the cell is able to safely generate NF3 for long periods of time without shut downs and restarts.

anode gas, and hydrogen was present in the anode gas mixture at flammable or nearly flammable concentrations. (Nitrogen gas was used as a purge gas and a diluent of the anode product gas for current up to 3000 A to minimize the hazards associated with the presence of hydrogen in the anode product gas.) In the examples having a current up to 1498 A, it was observed that hydrogen was present and fluorine was absent (or below detectable limits) in the anode product gas. When the current was increased to 1750 A and 2000 A, fluorine was observed with the absence of hydrogen in the anode product gas. At current above 3000 A, the nitrogen purge gas was turned off and the electrolyte could be maintained at a higher temperature to allow for higher $NF_3$ production along with the presence of sufficient quantity of fluorine in the anode product gas. When conditions were chosen so that fluorine was at or above approximately 0.5 mol %, the presence of hydrogen was avoided and the anode gas mixture was not flammable.

TABLE 1

| | Cell process conditions | | | | | Anode Gas Composition (mole %) Before dilution by Nitrogen purge gas | | | | | |
|---|---|---|---|---|---|---|---|---|---|---|---|
| Start up steps | Current A | Temperature ° C. | Nitrogen Purge NCMH | Fluorine $F_2$ | Hydrogen $H_2$ | Hydrofluoric acid HF | Nitrogen trifluoride $NF_3$ | Nitrogen $N_2$ | Carbon tetrafluoride $CF_4$ | Carbon tetrafluoride $N_2F_2$ | Explosive mixture (undiluted) |
| 1 | 500 | 118 | 0.57 | 0.00 | 8.02 | 6.00 | 4.02 | 81.9 | 0.0276 | 0.0393 | Yes |
| 2 | 1000 | 117 | 0.57 | 0.00 | 9.68 | 6.00 | 13.68 | 70.5 | 0.0170 | 0.1620 | Yes |
| 3 | 1250 | 119 | 0.57 | 0.00 | 4.32 | 6.00 | 19.31 | 70.2 | 0.0098 | 0.1122 | Yes |
| 4 | 1498 | 118 | 0.57 | 0.00 | 2.11 | 6.00 | 30.39 | 61.4 | 0.0066 | 0.1285 | No |
| 5 | 1750 | 117 | 0.57 | 0.82 | 0.00 | 6.00 | 33.26 | 59.8 | 0.0040 | 0.1548 | No |
| 6 | 2000 | 118 | 0.57 | 2.60 | 0.00 | 6.00 | 43.33 | 47.9 | 0.0038 | 0.1823 | No |
| 7 | 3000 | 125 | 0.57 | 9.06 | 0.00 | 6.00 | 43.31 | 41.4 | 0.0055 | 0.1854 | No |
| 8 | 3254 | 130 | 0.00 | 6.87 | 0.00 | 6.28 | 54.29 | 32.3 | 0.0074 | 0.3017 | No |
| 9 | 3252 | 130 | 0.00 | 6.53 | 0.00 | 5.91 | 55.54 | 31.7 | 0.0059 | 0.2759 | No |

EXAMPLES

The electrochemical cells used in the examples which follow are as described by A. P. Huber, J. Dykstra and B. H. Thompson, ": Multi-ton Production of Fluorine for Manufacture of Uranium Hexafluoride",*Proceedings of the Second United Nations International Conference on the Peaceful Uses of Atomic Energy*, Geneva Switzerland, Sep. 1-13, 1958. A 32 anode blade cell similar to the one utilized by Huber et al. and a 28 anode blade cell which was similar to the 32 anode blade except for four fewer blades were used. The anode blades were YBD-XX grade from Graftech International, with dimensions 2 inches×8 inches×20 inches. The body of the cell was made of Monel® with a height of 30 inches, a width of 32 inches and a length of 74 inches. The projected anode area was 5.264 $m^2$ for the 32 blade anode cell and 4.606 $m^2$ for the 28 blade anode cell. The ternary electrolyte consisted of 20 wt % $NH_4F$, and 46.0 wt % KF with a HF ratio of 1.5.

Example 1

A 28 anode blade cell described above was started up and operated at the temperature and current described in Table 1. The composition of the anode product gas is also shown in the table. This example shows that by modifying the temperature and the current, the fluorine in the anode product gas may be adjusted. When hydrogen is at or near 5 mol % in any composition of $NF_3$ greater than 10 mol % then the gas mixture is deemed to be flammable. In start up steps 1 through 4, the cell conditions were such that fluorine was not measured in the

Example 2

A cell similar to the one described in Example 1 was used except the cell contained 32 anode blades instead of 28 anode blades. When the cell was operating at 3918 A and 128 C with a HF ratio of 1.51 and the $NH_4F$ concentration of 17.4 wt %, the anode product gas contained 0.05 mol % fluorine. The current was increased to 5010 A, while simultaneously increasing the HF ratio to 1.53. The fluorine concentration increased to 1.11 mol %

Example 3

A cell similar to one described in Example 2 was operated at 3012 A at 130 C with $NH_4F$ concentration of 20.6 wt % and a HF ratio of 1.40. The anode product gas contained 0.01 mol % fluorine. The ammonia feed to the cell was turned off completely while the temperature was lowered by 3° C. to 127° C. The fluorine concentration in the anode product gas increased to 9.04 mol %.

We claim:

1. A process of controlling an electrolytic apparatus used for making nitrogen trifluoride comprising a body, an electrolyte, at least one anode chamber that produces an anode product gas, at least one cathode chamber, and one or more fluorine adjustment means to maintain a target excess concentration of fluorine in said anode product gas by adjusting the concentration of fluorine in said anode product gas to react with hydrogen to maintain a concentration of hydrogen below deflagration levels in said anode product gas, wherein said one or more fluorine adjustment means are selected from the group consisting of current, temperature, composition of the electrolyte, and flow of fluorine from an external fluorine gas supply, said process comprising the steps of:

(a) analyzing anode product gas;

(b) determining if hydrogen or fluorine are present within a targeted amount in said anode product gas; and if so going to step (d) below;

(c) adjusting one or more of said fluorine adjustment means to adjust the level of fluorine in said anode product gas; and (d) repeating steps (a) to (c).

2. The process of claim 1 wherein said one or more fluorine adjustment means are selected from the group of: current applied to the cell if said current will not be outside of a targeted range for said current if said current is adjusted, temperature of the electrolyte if said temperature will not be outside of a targeted range for said temperature if said temperature is adjusted, composition of the electrolyte if said composition will not be outside a targeted range for said composition and the electrolyte composition will stay between the maximum and minimum level for said electrolyte composition if said electrolyte composition is adjusted, and the flow from a fluorine gas supply if said flow rate will not be outside a targeted range for said flow from a fluorine gas supply if it is adjusted.

3. The process of claim 2 further wherein the targeted amount determined in step (b) is from 0.1 to 5 mol % fluorine.

4. The process of claim 1 further wherein the adjusting of one or more of said fluorine adjusting means of step (c) is one or more of the following steps when the amount of fluorine is below or hydrogen is above the targeted concentration as measured in step (b):

adding hydrogen fluoride to the electrolyte; decreasing the amount of ammonia in the electrolyte; lowering the operating temperature; increasing the amount of current applied to the cell; and/or flowing a gas stream of fluorine into the cell or into the anode product gas stream from a fluorine gas supply.

5. The process of claim 1 further wherein the adjusting of one or more of said fluorine adjusting means of step (c) is one or more of the following steps when the amount of fluorine is above the targeted amount as measured in step (b):

reducing the amount of hydrogen fluoride in the electrolyte; increasing the amount of ammonia in the electrolyte; increasing the operating temperature; decreasing the amount of current applied to the cell; and/or reducing or stopping the flow of a fluorine gas into the cell or into the anode product gas stream from a fluorine gas supply.

6. The process of claim 1 further wherein the targeted amount determined in step (b) is from 0.1 to 5 mol % fluorine.

7. The process of claim 1 further wherein the targeted amount determined in step (b) is less than 5 mol % hydrogen.

8. The process of claim 1 wherein the adjusting step (c) further comprises the step of:

(i) measuring the electrolyte composition and adjusting said electrolyte composition if after adjusting said electrolyte composition said electrolyte composition will stay within a targeted amount for the electrolyte composition and within the maximum and minimum levels for the electrolyte in said cell.

9. The process of claim 8 wherein if said electrolyte composition cannot be adjusted, the adjusting step (c) further comprises the step of:

(ii) measuring the temperature of the electrolyte and adjusting the temperature of the electrolyte if said adjusting the temperature of the electrolyte will remain within a targeted temperature range for the electrolyte.

10. The process of claim 9 wherein if said electrolyte composition and said temperature cannot be adjusted, the adjusting step (c) further comprises the step of:

(iii) measuring the current applied to the cell and adjusting the current applied to the cell if adjusting said current will remain within a targeted current range for the cell.

11. The process of claim 10 wherein if said electrolyte composition, said temperature, and said current cannot be adjusted, the adjusting step (c) further comprises the step of:

(iv) signaling an operator.

12. The process of claim 10 wherein if said electrolyte composition, said temperature, and said current cannot be adjusted, the adjusting step (c) further comprises the step of:

(iv) measuring the flow of fluorine into the anode product gas and adjusting the flow of fluorine into the anode product gas.

13. The process of claim 1, further comprising the step of adding inert gas to said anode product gas if more than 5 mol % of hydrogen is detected in the anode product gas in step (b).

14. The process of claim 1 wherein said fluorine adjusting means are electrolyte composition and temperature.

* * * * *